US006052546A

United States Patent [19]

Aslam

[11] Patent Number: 6,052,546

[45] Date of Patent: Apr. 18, 2000

[54] FUSER FOR REPRODUCTION APPARATUS WITH MINIMIZED TEMPERATURE DROOP

[75] Inventor: Muhammed Aslam, Rochester, N.Y.

[73] Assignee: Eastman Kodak Company, Rochester, N.Y.

[21] Appl. No.: 09/197,686

[22] Filed: Nov. 20, 1998

[51] Int. Cl.[7] ..... G03G 15/20

[52] U.S. Cl. ..... 399/70; 399/330; 219/216

[58] Field of Search ..... 399/70, 69, 328–334; 219/216

[56] References Cited

U.S. PATENT DOCUMENTS 5,053,828 10/1991 Ndebi et al .
5,055,884 10/1991 Ndebi et al. .

*Primary Examiner*—Richard Moses
*Attorney, Agent, or Firm*—Lawrence P. Kessler

[57] ABSTRACT

A fuser, for a reproduction apparatus, having at least one heated fuser roller operating at a setpoint temperature to permanently fix a marking particle image to a receiver member, and a mechanism for controlling temperature droop in the heated fuser roller. The temperature droop controlling mechanism includes an external heat source movable to a position in operative contact with the heated fuser roller and a nonoperative position remote from the heated fuser roller. A logic and control unit is provided for moving the external heat source from the nonoperative remote position to the operative position the heated fuser roller on start up of the reproduction apparatus, and as soon as a reproduction operation job run is started, to supply heat to the heated fuser roller thus maintaining its surface temperature substantially at the setpoint temperature. The unit also turns on a fuser roller heating device to bring the heated fuser roller surface temperature toward the setpoint temperature. When the heated fuser roller has been reheated to its setpoint temperature, the logic and control unit moves the external heat source to the nonoperative position remote from the heated fuser roller, whereby temperature droop in the heated fuser roller is minimized.

6 Claims, 1 Drawing Sheet

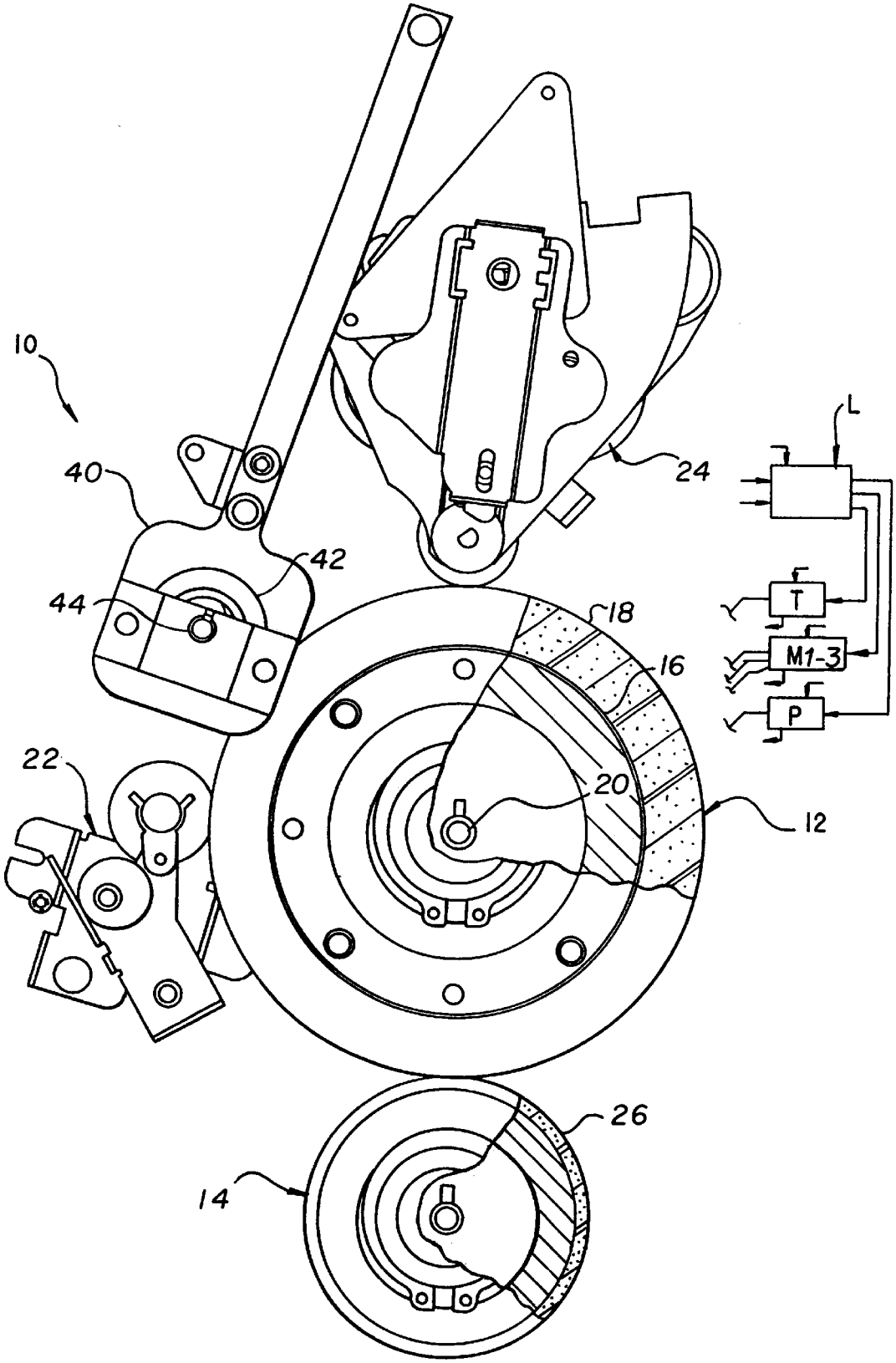
10
40
42
44
22
24
L
T
M1-3
P
18
16
20
12
26
14

FUSER FOR REPRODUCTION APPARATUS WITH MINIMIZED TEMPERATURE DROOP

CROSS-REFERENCE TO RELATED APPLICATIONS

U.S. Ser. No. 09/197,734, filed Nov. 20, 1998, entitled "MAXIMIZING IMAGE GLOSS UNIFORMITY BY MINIMIZING THE EFFECT OF TEMPERATURE DROOP IN A FUSER FOR REPRODUCTION APPARTUS";

U.S. Ser. No. 09/197,365, filed Nov. 20, 1998, entitled "FUSER FOR REPRODUCTION APPARATUS WITH MINIMIZED TEMPERATURE DROOP";

U.S. Ser. No. 09/197,296, filed Nov. 20, 1998, entitled "FUSER FOR REPRODUCTION APPARATUS WITH MINIMIZED TEMPERATURE DROOP";

FIELD OF THE INVENTION

The present invention relates in general to a fuser for a reproduction apparatus, and more particularly to a reproduction apparatus fuser which exhibits minimized temperature droop.

BACKGROUND OF THE INVENTION

In typical commercial reproduction apparatus (electrostatographic copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

One type of fuser apparatus, utilized in typical reproduction apparatus, includes at least one heated roller and at least one pressure roller in nip relation with the heated roller. The fuser apparatus rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

When the reproduction apparatus is first turned on, fuser roller heating begins so as to bring the fuser roller up to a selected setpoint temperature. This, of course, takes some for the fuser roller to reach the operating setpoint temperature. Moreover, when the reproduction apparatus is in the standby mode between job runs, the heated fuser roller will be in a substantially equilibrium condition; that is, there is at most only a small temperature gradient between the outer surface of the fuser roller and the inner core. Then when the job run begins energy (heat) is removed from the fuser roller to the copies being fused. As a result, the temperature at the outer surface of the fuser roller droops very quickly. Since the temperature droops from the operating setpoint, the logic and control for the reproduction apparatus turns on the fuser heating device. However, depending upon the thickness of the fuser roller, there is a time lag until the fuser roller surface receives enough energy to get back to the desired fusing temperature. During the time lag, the droop in surface temperature causes inferior fusing quality. When the reproduction apparatus is a process color machine, the temperature droop results in objectionable lower saturation of colors and image gloss.

To overcome fuser roller temperature droop at the start of a reproduction run, some apparatus include temperature control algorithms that raise the fuser roller temperature at the start of the run above the run temperature set point. That is, the energy input is started earlier so that the temperature droop from the setpoint is minimized. However, this causes the fuser roller temperature to be higher at the start of a job run than the desired setpoint and lower at the bottom of the temperature droop. Therefore, the copies over a job run will be fused at differing temperatures and have differing image quality appearance.

SUMMARY OF THE INVENTION

In view of the above, this invention is directed to a fuser, for a reproduction apparatus, having at least one heated fuser roller operating at a setpoint temperature to permanently fix a marking particle image to a receiver member, and a mechanism for controlling temperature droop in the heated fuser roller. The temperature droop controlling mechanism includes an external heat source movable to a position in operative contact with the heated fuser roller and a nonoperative position remote from the heated fuser roller. A logic and control unit is provided for moving the external heat source from the nonoperative remote position to the operative position the heated fuser roller on start up of the reproduction apparatus, and as soon as a reproduction operation job run is started, to supply heat to the heated fuser roller thus maintaining its surface temperature substantially at the setpoint temperature. The unit also turns on a fuser roller heating device to bring the heated fuser roller surface temperature toward the setpoint temperature. When the heated fuser roller has been reheated to its setpoint temperature, the logic and control unit moves the external heat source to the nonoperative position remote from the heated fuser roller, whereby temperature droop in the heated fuser roller is minimized.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

The FIGURE is a side elevational view of a reproduction apparatus fuser, with portions removed to facilitate viewing, the fuser having a temperature droop control mechanism according to this invention.

DETAILED DESCRIPTION OF THE INVENTION

Referring now to the accompanying drawings, a typical reproduction apparatus fuser, designated generally by the numeral 10, is shown. The fuser apparatus 10 includes a fuser roller 12 in nip relation with a pressure roller 14.

Rotation of the fuser apparatus rollers by any suitable drive mechanism (such as a motor $M_1$ designated schematically in the FIGURE) will serve to transport a receiver member bearing a marking particle image through the nip under the application of heat and pressure. The receiver member may be, for example, a sheet of plain bond paper, or transparency material. The heat will soften the marking particles and the pressure will force the particles into intimate contact and to be at least partially imbibed into the fibers at the surface of the receiver material. Thus, when the marking particles cool, they are permanently fixed to the as receiver member in an image-wise fashion.

The fuser roller 12 includes a core 16 and a cylindrical fusing blanket 18 supported on the core. The blanket 18 is typically made of a rubber material particularly formulated to be heat conductive or heat insulative dependent upon whether the fuser heat source is located within the core 16 or in juxtaposition with the periphery of the blanket. In the illustrated preferred embodiment, the heat source is an internal heater lamp designated by the numeral 20. A well known suitable oiler mechanism 22 selectively applies an oil to the blanket 18 of the fuser roller to substantially prevent offsetting of the marking particle image to the fuser roller 12. Additionally, a suitable cleaning mechanism 24 wipes the fuser roller surface to remove excess offset preventing oil and other contaminants which would degrade the quality of the image fused to the receiver member.

The pressure roller 14 has a hard outer shell 26. Typically, the shell 26 is made of metal, such as aluminum or steel for example. The shell 26 may also have a well known suitable surface coating (not shown) applied thereto to substantially prevent offsetting of the marking particle image to the pressure roller 14. Any well known suitable pressure mechanism (such as a motor $M_2$ designated schematically in the FIGURE) selectively applies a particular force to create a desired pressure in the nip to effect the fusing of the marking particle image to the receiver member travelling through the nip. Skive mechanisms (not shown) are respectively associated with the fuser roller 12 and the pressure roller 14 for removing any receiver members which inadvertently adhere to the roller surfaces. Downstream of the nip between the fuser roller 12 and the pressure roller 14 is a transport device (not shown) for feeding receiver members away from the nip. Further, the fuser 10 includes a cleaning mechanism 20 which engages the fusing roller 12 to clean the surface thereof.

The fuser apparatus 10 is controlled by a logic and control unit L for the reproduction apparatus. The unit L receives signals, from apparatus processing stations and receiver member location sensors about the processing path, fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

In order to control fuser roller temperature droop, according to this invention, an external heat source mechanism 40 is provided. The external heat source mechanism 40 of the preferred embodiment includes a roller 42 having an internal heating lamp 44. The roller 42 has a longitudinal axis parallel to the longitudinal axis of the heated fuser roller 12. Of course, any suitable heating source may be used with this invention. The external heat source mechanism 40 is supported by any well known mechanism (such as a motor $M_3$ designated schematically in the FIGURE) for movement to an operative position in contact with the fuser roller 12 (solid line position in the FIGURE), and to a non-operative position remote from the surface of the fuser roller. The external heat source mechanism is controlled by the logic and control unit L of the reproduction apparatus in the manner described below.

When the reproduction apparatus is first turned on (i.e., during the warm-up cycle), a signal is sent from the logic and control unit L to the mechanism $M_3$ to move the external heat source mechanism 40 from the nonoperative remote position to the operative position contacting the surface of the fuser roller 12. On contact, the external heat source mechanism immediately starts to supply heat to the fuser roller. Therefore, the surface of the fuser roller will reach the setpoint operating temperature at a much faster rate then heretofore known in prior reproduction apparatus. The external heat source mechanism 40 remains in operative contact with the fuser roller 12 until the setpoint operating temperature is reached. At such time, the logic and control unit L then sends a signal to the motor $M_3$ to move the external heat source mechanism to the nonoperative position remote from the fuser roller 12.

Further, when the reproduction apparatus, from the standby mode between job runs, begins a job run, a signal is sent from the logic and control unit L to the motor $M_3$ to move the external heat source mechanism 40 from the nonoperative remote position to the operative position contacting the surface of the fuser roller 12. While heat is removed from the fuser roller by the copies being fused, the temperature at the outer surface of the fuser roller would otherwise droop very quickly. Even though the logic and control L turns on the fuser heating device (for example heater 20) to bring the fuser roller back up to the setpoint operating temperature, there is a time lag until the fuser roller surface receives enough energy to return to the desired fusing setpoint temperature.

The temperature droop is minimized by application of heat from the external heat source mechanism 40. Thus, during the fusing of the early receiver members in a reproduction run, the temperature droop has, for the most part, recovered. As such, the fusing temperature during a reproduction job run remains substantially at the same desired setpoint. Accordingly, the fusing quality (and thus the overall appearance quality) of the images over the job run will be substantially the same. Once the surface temperature of the fuser roller has been raised by its internal heat source to the setpoint temperature, the logic and control unit L sends a signal to the motor $M_3$ to move the external heat source mechanism to the nonoperative position remote from the fuser roller 12.

The invention has been described in detail with particular reference to certain preferred embodiments thereof, but it will be understood that variations and modifications can be effected within the spirit and scope of the invention.

What is claimed is:

1. A fuser, for a reproduction apparatus, having at least one heated fuser roller operating at a setpoint temperature to permanently fix a marking particle image to a receiver member at a nip formed between the heated fuser roller and an associated pressure roller, and a mechanism for controlling temperature droop in said at least one heated fuser roller, said temperature droop controlling mechanism comprising:

an external heat source movable to a position in operative contact with said at least one heated fuser roller and a nonoperative position remote from said at least one heated fuser roller; and a logic and control unit for moving said external heat source from said nonoperative remote position to said operative position contacting said at least one heated fuser roller on start up of the reproduction apparatus, and as soon as a reproduction operation job run is started, to supply heat to said at least one heated fuser roller thus maintaining its surface temperature substantially at said setpoint temperature, turning on a fuser roller heating device to bring said at least one heated fuser roller surface temperature toward said setpoint temperature, and when said at least one heated fuser roller has been reheated to its setpoint temperature, moving said external heat source to said nonoperative position remote from said at least one heated fuser roller, whereby temperature droop in said at least one heated fuser roller is minimized.

2. The temperature droop controlling mechanism according to claim 1 wherein said external heat source is a roller having a longitudinal axis parallel to the longitudinal axis of said at least one heated fuser roller.

3. A fuser, for a reproduction apparatus, for permanently fixing a marking particle image to such receiver member, said fuser comprising:

a heated fuser member operating at a setpoint temperature;

a pressure roller associated with the heated fuser member to form a nip there between;

an external heat source movable to a position in operative contact with said at least one heated fuser roller and a nonoperative position remote from said at least one heated fuser roller; and logic and control unit for moving said external heat source from said nonoperative remote position to said operative position contacting said at least one heated fuser member on start up of the reproduction apparatus, and as soon as a reproduction operation job run is started, to supply heat to said at least one heated fuser member thus maintaining its surface temperature substantially at said setpoint temperature, turning on a fuser member heating device to bring said at least one heated fuser member surface temperature toward said setpoint temperature, and when said at least one heated fuser member has been reheated to its setpoint temperature, moving said external heat source to said nonoperative position remote from said at least one heated fuser member, whereby temperature droop in said at least one heated fuser member is minimized.

4. The reproduction apparatus fuser according to claim 3 wherein said heated fuser member is a roller.

5. The reproduction apparatus fuser according to claim 4 wherein said external heat source is a roller having a longitudinal axis parallel to the longitudinal axis of said heated fuser roller.

6. In a fuser, for a reproduction apparatus, having at least one heated fuser member operating at a setpoint temperature to permanently fix a marking particle image to a receiver member, a method for controlling temperature droop in said heated fuser member, said temperature droop controlling method comprising the steps of:

on start up of the reproduction apparatus, and as soon as a reproduction operation job run is started, moving an external heat source mechanism from a nonoperative remote position to an operative position contacting said heated fuser member to supply heat to said at least one heated fuser member thus maintaining its surface temperature substantially at the setpoint temperature;

turning on the fuser heating device to bring the fuser member surface temperature back up toward the setpoint temperature; and when said at least one heated fuser member has been reheated to its setpoint temperature, moving said external heat source to said nonoperative position remote from said at least one heated fuser member, whereby temperature droop in said at least one heated fuser member is minimized.

* * * * *